United States Patent [19]

Schieber et al.

[11] 3,930,985

[45] Jan. 6, 1976

[54] METHOD OF PRODUCING SPECIAL COKES

[76] Inventors: Franz Schieber, Pegnitzstrasse 12, 8505 Rothenbach, Germany; Petar Husnjak, M. Tita 8; Frane Paro, Rade Koncara, both of Sisak, Yugoslavia; Konrad Koziol, Pegnitzstrasse 12; Baptist Zenk, Muhlhof 1, both of 8505 Rothenbach, Germany; Nada Lenac-Lukacevic, M. Tita 6, Sisak, Yugoslavia; Dieter Zöllner, Handlstr. 99, 8501 Schwaig, Germany; Peter Walser, Grunthal 1, 8505 Rothenbach, Germany; Friedrich Rittmann, Am Buck 18, 8501 Ruckersdorf, Germany

[22] Filed: May 8, 1972

[21] Appl. No.: 251,026

[30] Foreign Application Priority Data

May 7, 1971 Germany ..... 2122620

[52] U.S. Cl. ..... 208/46; 208/131

[51] Int. Cl.[2] ..... C10G 9/14

[58] Field of Search ..... 208/131, 46, 106

[56] References Cited

UNITED STATES PATENTS

| | | | |
|---|---|---|---|
| 2,775,549 | 12/1956 | Shea | 208/131 |
| 2,922,755 | 1/1960 | Hackley | 208/106 |
| 3,344,057 | 9/1967 | Patrick | 208/106 |
| 3,493,489 | 2/1970 | Naniche | 208/50 |
| 3,704,224 | 11/1972 | Scovill et al. | 208/46 |

*Primary Examiner*—Herbert Levine
*Attorney, Agent, or Firm*—McGlew and Tuttle

[57] ABSTRACT

A method of making special cokes according to which a mixture of from 50–90% by weight of an atmospheric distillation residue of a petroleum, e.g. a Pannonian petroleum, with a density of from 0.935–0.965 grams per cubic centimeter, a viscosity of from 2.8°–4.3° Engler at 100°C, a sulfur content of from 0.85–1.10%, a coke value according to Conradson of from 5–7 %, an aromatics content of from 40–60%, an asphalt content below 1.8% with a boiling component of less than 20% within the temperature range of from 250°–350°C, and a content in ash forming elements of less than 0.05% is coked together with from 10–50% by weight of a catalyst-free catalytic residue obtained by catalytic cracking of a distillate low in ashes, e.g. gas oil, which last mentioned residue has a density of from 0.90–0.95 grams per cubic centimeter, a viscosity of from 2.5°–3.2° Engler at 50°C, a sulfur content less than 0.6%, a coke value according to Conradson of from 3.5–4.5%, an aromatics content of more than 35%, an asphalt content of less than 0.6%, and boiling components of from 8 to 12% for the range of from 250°–300°C and from 30–40% within the temperature range of from 300°–350°C in a 24 to 48 hour cycle at temperatures of from 475°–515°C and at a pressure of from 3–7 atmospheres above atmospheric pressure at a high recycling ratio.

3 Claims, No Drawings

METHOD OF PRODUCING SPECIAL COKES

The present invention relates to a method of producing special cokes which are suitable for making graphite electrodes which are adapted to be loaded thermally and electrically to an extremely high degree and which are intended for use in ultra-high-power electric arc furnaces (UHP-furnaces).

Such graphite electrodes, in addition to having a high mechanical strength, must be thermoshock-resistant, which means that also at very high temperature differences over relatively short time intervals the electrode must remain tear-free. This thermoshock resistance is greatly influenced by the type of raw material employed for the production of the electrode.

The increasing competition of the individual steel producing methods made it mandatory to improve the economy in connection with the electrosteel production, for instance by employing larger units of electric arc furnaces with a higher melting output. The operation of such output-intensive furnaces became possible only after, on one hand, in view of the construction of larger transformers, it was made possible to supply the necessary electric energy and, on the other hand, after a long development phase it became possible to furnish graphite electrodes of high electric capacity and of great thermoshock resistance.

Of primary importance in connection with the manufacture of graphite electrodes having a low heat expansion coefficient, a high electric and thermal conductivity and a good mechanical strength is the employment of cokes with certain definite quality features. The cokes suited for this purpose must in addition to having a high density and a low sulfur content, above all, be adapted to be well graphitized and must have a low thermal expansion coefficient. These cokes, as a rule, have a longitudinal spiky or stalked structure and when observed under the microscope show large anisotropy regions.

A number of methods have become known to produce cokes of the just described properties. With all heretofore known methods a specially prepared feedstock is converted into coke by the delayed coking method. The goal of these known methods consists in so to prepare or generate the starting product for the manufacture of coke that it will contain as small quantities as possible of asphaltic, naphthenic and soot-like substances which initiate a too fast and structurally random coke formation.

According to some of these heretofore known methods also certain petroleum components or bituminous coal tar fractions with certain boiling limits are employed. Thus, for instance, Kendall coke was produced by coking raw oil distillation residues. The thus produced cokes, however, yielded only a slight increase in the anisotropic properties which does not suffice to meet the modern requirements of special cokes for the production of high capacity electrodes.

Nowadays the starting substances for the coker feedstock are, for instance, extracted, cracked and distilled or centrifuged. The feedstock is, primarily with customary methods for producing premium cokes, a mixture of a high proportion of cracked tars or aromatic decanting oils with gas oils or extracts as well as of relatively small proportions of residues of the atmospheric distillation.

These heretofore known methods have the drawback that the production of the feedstock is rather expensive.

It is, therefore, an object of the present invention to provide an economic method for producing special cokes which are suitable for the production of electrodes which are adapted to be subjected to high electric and thermal loads.

This object and other objects and advantages of the invention have been realized according to the present invention by employing as coker feedstock a combination of primarily atmospheric distillation residues with precisely specified characteristic values with relatively small quantities of catalyst-free catalytic residues. This combination which is surprising with respect to the proportion of its components yields a special coke with excellent properties with regard to the production of high-capacity electrodes. Numerous tests have shown, however, that this result can be realized only when employing feedstock components with the characteristic values and properties according to the present invention. Already relatively small deviations will yield cokes of reduced quality. These substances are in conformity with the present invention coked together in customary manner in the proportions by weight according to the present invention without the necessity of a pretreatment, while a 24 to 48 hour cycle is used at temperatures of 475°–515°C, at pressures of from 3–7 atmospheres above atmospheric pressure and while a high recycling ratio is employed.

The present invention is characterized primarily in that, in contrast to heretofore known methods, the high proportion of from 50 to 90% by weight of an atmospheric distillation residue of certain mineral oils, as for instance Pannonian oils, having a density of from 0.935 to 0.965 gr/cm$^3$, a viscosity of from 2.8° to 4.3° Engler at 100°C, a sulfur content of from 0.85 to 1.10%, a coke value according to Conradson of from 5 to 7%, an aromatics content of from 40 to 60%, an asphalt content below 1.8%, with a boiling component less than 20% in the temperature range of from 250° to 350°C, and a content of ashes forming elements less than 0.05% is coked together with from 10 to 50% by weight of a catalyst-free catalytic residue obtained by a catalytic cracking of distillates low in ashes, for instance, gas oils. These catalyst-free catalytic residues have a density of from 0.90 to 0.95 gr/cm$^3$, a viscosity of from 2.5° to 3.2° Engler at 50°C, a sulfur content of less than 0.6%, a coke value according to Conradson of from 3.5 to 4.5%, an aromatics content of more than 35%, an asphalt content of less than 0.6% and boiling components of from 8 to 12% for the range of from 250° to 300°C and of from 30 to 40% for the temperature range of from 300° to 350°C. The mixture is coked in a cycle lasting from 24 to 48 hours at temperatures of from 475° to 515°C, pressures of from 3 to 7 atmospheres above atmospheric pressure and at a high recycling ratio. In this way a yield in green coke of primarily from 20 to 30% is obtained. The necessary criterions or characteristic factors of the atmospheric feedstock proportion are without difficulties obtained during the distillation of oils from the deposits in Pannonia.

The production of the starting material required for the method according to the present invention, namely the atmospheric distillation residues and the catalyst-free catalytic residues, is carried out in customary manner.

The heretofore produced cokes are, as far as they have properties which are satisfactory for the later purpose of application, made with a far preponderant proportion of catalytic components.

Surprisingly it has been found that already with considerably lower proportions of from 10 to 50%, preferably of from 20 to 40%, of catalyst-free catalytic residue mixed with atmospheric residue while precisely maintaining the criterions or characteristic factors according to the invention of the atmospheric distillation residue and with a high recycle, cokes with a very low thermal expansion behavior can be obtained.

The atmospheric residue employed in conformity with the invention for producing the special coke according to the invention yields with different charges the following criterions or characteristic factors:

| | Example 1 | Example 2 |
|---|---|---|
| Water content | % | 0.1 to 0.3 |
| Volatile components | % | 0.2 to 0.5 |
| Ash content | % | 0.05 to 0.2 |
| Sulfur content | % | 0.8 to 1.0 |
| Actual density after calcining at 1300°C | gr/cm³ | 2.11 to 2.13 |
| Thermal volume expansion coefficient $\alpha_V$ of graphitized press bodies after treatment at 2700°C | $10^{-6}$/°C | 3.5 to 4.0 |
| Thermal expansion coefficient $\alpha_L$ of the coke processed into graphite rods | $10^{-6}$/°C | 0.7 to 0.8 |
| Grain shape | | longitudinally spiky |
| Appearance | | metallic shining, spiky or stalked texture, crystalline |
| Texture | | dense, poor in pores, strong-walled |
| Structure | | high degree of anisotropy, good structural pre-orientation, presence of large-surfaced homogeneously formed longitudinally directed ranges of anisotropy |
| Graphitizing ability | | very good. |

| | | Pannonic oil Origin A | Pannonic oil Origin B |
|---|---|---|---|
| Density | gr/cm³ | 0.935 | 0.936 |
| Sulfur | % | 0.98 | 0.95 |
| Viscosity at 100°C | °E | 2.67 | 3.81 |
| Coke value according to Conradson | % | 5.10 | 6.56 |
| Aromatics, content | % | 44 | 57 |
| Asphalt content | % | 0.9 | 1.6 |
| Boiling range (250° - 350°C) | % | 15.6 | 16.5 |
| Ashes forming elements | % | 0.05 | 0.02 |

The catalyst-free catalytic residue, which is mixed-in at the proportion of primarily from 20 to 40%, showed the following coefficients:

| | |
|---|---|
| Density | 0.93 gr/cm³ |
| Viscosity at 50°C | 2.8 °E |
| Sulfur content | 0.5 % |
| Coke value according to Conradson | 4.1% |
| Aromatics content | 38 % |
| Asphalt content | 0.5 % |
| Boiling range (250°-350°C) | 8.45 % |
| Ashes forming elements | 0.01 %. |

In the delayed coker 800 tons of feedstock were introduced and, more specifically, at the ratio of 60 % atmospheric residue to 40% catalyst-free catalytic residue.

The coker charging temperature was 487°C. The pressure amounted to 4.6 atmospheres above atmospheric pressure, and the staying time in the coker was 36 hours. As a recycle ratio there was used 1:2.13. The yield in green coke was 26 %. With the top distillate, in contrast to the normal charges, the gas oil proportion increased whereas the quantity of gasoline decreased. The contents in $C_3$ and $C_4$ were less than normal.

The ascertained characteristic values for the green coke were as follows:

| | | |
|---|---|---|
| Volatile components | 6.5 - 8.5 | % |
| Actual density | 1.37 - 1.39 | gr/cm³ |
| Virtual density | 0.98 | gr/cm³ |
| Sulfur | 1.11 - 1.15 | % |
| Ashes | 0.06 | % |
| Structure: | Longitudinally-spiky or stalked, anisotropic. | |

The coke is then in customary manner calcined in a rotary furnace at 1250°C.

The coke calcinate, in a plurality of tests, yielded the following analysis data:

It appears to be interesting that the properties of the produced coke will decrease in quality when in the feedstock according to the invention, with the characteristic values according to the invention for the atmospheric component, the proportion in catalyst-free catalytic residue is increased. Thus, for instance, the true density of the coke will drop from 2.11 to 2.13 gr/cm³ at a catalyst-free catalytic residue proportion of from 20 to 40% to 2.09 gr/cm³ at a catalyst-free catalytic residue proportion of more than 50%.

The porosity of the coke is most favorable with the starting feedstock combination according to the invention of from 20 to 40% of the catalyst-free catalytic residue proportion. The pores are of intermediate size. Already at a catalyst-free catalytic residue proportion exceeding 50% the pores of the coke change and have a larger cross section. The anisotropy ranges, on the other hand, will have a smaller surface with a proportion of the catalyst-free catalytic residue exceeding 50%. This tendency continues up to the cokes which are produced from pure catalyst-free catalytic residue.

It is also to be noted that the yield in green coke is a maximum with 20 to 30% catalyst-free catalytic residue. This appears to point to special chemical processes which are assumed to be inherent to the specific composition of the feedstock components obtained from the Pannonian oil.

There is provided a method of producing cokes for use in connection with the making of ultra-high-power electrodes which includes the steps of: coking a mixture of from 50 to 90% by weight of atmospheric petroleum distillation residues having a density of from 0.935 to 0.965 grams per cubic centimeter, a viscosity of from 2.8° to 4.3° Engler at 100° C, a sulfur content of from 0.85 to 1.10%, a coke value according to Conradson of from 5 to 7%, a content in aromates of from 40 to 60%, an asphalt content below 1.8% with a boiling component less than 20% within the temperature range of from 250° to 350° C, and with a content in ash forming elements of less than 0.05% and with from 10 to 50% by weight of an oil selected from the group consisting of petrochemical gas oils and circulatory oils with a boiling range of from 250° to 370° C.

The above described invention yields the possibility of economically producing special cokes as they are needed for high capacity graphite electrodes in UHP-use inasmuch as, on one hand, the heretofore necessary expensive pretreatments of the coker feedstock become superfluous while, on the other hand, already a considerably smaller proportion of the catalyst-free catalytic residue will suffice for producing special electrode cokes in customary manner from oils which have the characteristic values in the feedstock, as for instance the oils from the Pannonic Basin.

It is, of course, to be understood that the present invention is, by no means, limited to the specific examples set forth above but also comprises any modifications within the scope of the appended claims.

What we claim is:

1. A method of producing cokes for use in connection with the making of ultra-high-power electrodes which includes in combination the steps of: coking a mixture of from 50 to 90% by weight of atmospheric virgin reduced crude oil having a density of from 0.935 to 0.965 grams per cubic centimeter, a viscosity of from 2.8° to 4.3° Engler at 100°C, a sulfur content of from 0.85 to 1.10%, a coke value according to Conradson of from 5 to 7%, a content in aromatics of from 40 to 60%, an asphalt content below 1.8% with a boiling component less than 20% within the temperature range of from 250° to 350°C, and with a content in ash forming elements of less than 0.05% and with from 10 to 50% by weight of a catalyst-free catalytic residue which has been obtained by catalytic cracking of distillates low in residues and ashes and which has a viscosity of from 2.5° to 3.2° Engler at 50°C, with a sulfur content of less than 0.6%, a coke value according to Conradson of from 3.5 to 4.5%, a content in aromatics exceeding 35%, an asphalt content of less than 0.6% and boiling components of from 8 to 12% for the range of from 250° to 300°C and boiling components of from 30 to 40% for the range of from 300° to 350°C in a 24 to 48 hour cycle at temperatures of from 475° to 515°C at pressures of from 3 to 7 atmospheres above atmospheric pressure, said coking being effected at such a recycling ratio as to obtain a yield in green coke of from 15 to 40%, in which as atmospheric virgin reduced crude oil residues there are used atmospheric distillation residues from Pannonian petroleum.

2. A method in combination according to claim 1, in which said catalyst-free catalytic residue is obtained by cracking gas oils.

3. A method of producing cokes for use in connection with the making of ultra-high-power electrodes which includes in combination the steps of: coking a mixture of from 50 to 90% by weight of atmospheric virgin reduced crude oil having a density of from 0.935 to 0.965 grams per cubic centimeter, a viscosity of from 2.8° to 4.3° Engler at 100°C, a sulfur content of from 0.85 to 1.10%, a coke value according to Conradson of from 5 to 7%, a content in aromatics of from 40 to 60%, an asphalt content below 1.8% with a boiling component less than 20% within the temperature range of from 250° to 350°C, and with a content in ash forming elements of less than 0.05% and with from 10 to 50% by weight of a catalyst-free catalytic residue which has been obtained by catalytic cracking of distillates low in residues and ashes and which has a viscosity of from 2.5° to 3.2° Engler at 50°C, with a sulfur content of less than 0.6%, a coke value according to Conradson of from 3.5 to 4.5%, a content in aromatics exceeding 35%, an asphalt content of less than 0.6% and boiling components of from 8 to 12% for the range of from 250° to 300°C and boiling components of from 30 to 40% for the range of from 300° to 350°C in a 24 to 48 hour cycle at temperatures of from 475° to 515°C at pressures of from 3 to 7 atmospheres above atmospheric pressure, said coking being effected at such a recycling ratio as to obtain a yield in green coke of from 15 to 40%.

* * * * *

UNITED STATES PATENT OFFICE

CERTIFICATE OF CORRECTION

Patent No. 3,930,985 Dated January 6, 1976

Inventor(s) Franz Schieber et al

It is certified that error appears in the above-identified patent and that said Letters Patent are hereby corrected as shown below:

On the Title Page, Item [73] should read:

--- C. Conradty and Ina-Prerada-Zagreb Rafinerija Sisak ---.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*